US006796246B1

(12) United States Patent
Atzpodien et al.

(10) Patent No.: US 6,796,246 B1
(45) Date of Patent: Sep. 28, 2004

(54) GIRDER FOR THE PRODUCTION OF A TRACK FOR A TRACK-BOUND VEHICLES, IN PARTICULAR A MAGNETIC LEVITATION RAILWAY, AND TRACK PRODUCED THEREWITH

(75) Inventors: Hans Christoph Atzpodien, Ratingen-Hösel (DE); Luitpold Miller, Ottobrunn (DE)

(73) Assignee: Thyssenkrupp Transrapid GmbH, Kassel (DE)

( * ) Notice: Subject to any disclaimer, the term of this patent is extended or adjusted under 35 U.S.C. 154(b) by 106 days.

(21) Appl. No.: 10/048,296

(22) PCT Filed: Aug. 12, 2000

(86) PCT No.: PCT/EP00/07879

§ 371 (c)(1),
(2), (4) Date: Jan. 24, 2002

(87) PCT Pub. No.: WO01/20080

PCT Pub. Date: Mar. 22, 2001

(30) Foreign Application Priority Data

Sep. 16, 1999 (DE) ..... 199 46 105

(51) Int. Cl.[7] ..... B60L 13/00
(52) U.S. Cl. ..... 104/286; 104/281
(58) Field of Search ..... 104/281, 282, 104/286, 292, 283, 284, 124, 118; 52/167.4, 167.1; 14/73.5, 74.5; 248/68.1, 74.1

(56) References Cited

U.S. PATENT DOCUMENTS

| | | | | |
|---|---|---|---|---|
| 3,924,907 A | * | 12/1975 | Czernik et al. | 384/36 |
| 4,696,235 A | * | 9/1987 | Wagner | 104/124 |
| 4,698,895 A | * | 10/1987 | Miller et al. | 29/464 |
| 5,027,713 A | * | 7/1991 | Kindmann et al. | 104/124 |
| 5,097,769 A | * | 3/1992 | Raschbichler et al. | 104/124 |
| 5,370,059 A | | 12/1994 | Raschbichler et al. | |
| 5,893,187 A | * | 4/1999 | Fukuoka | 14/74.5 |
| 5,918,850 A | * | 7/1999 | Domange et al. | 248/636 |
| 6,112,488 A | * | 9/2000 | Olson et al. | 52/393 |
| 6,131,352 A | * | 10/2000 | Barnes et al. | 52/396.01 |

FOREIGN PATENT DOCUMENTS

| | | | |
|---|---|---|---|
| DE | 3142276 A | | 5/1983 |
| DE | 34040617 | | 2/1984 |
| DE | 3928277 C1 | | 8/1989 |
| DE | 3928278 C2 | | 8/1989 |
| JP | 07054310 | * | 2/1995 |

* cited by examiner

*Primary Examiner*—S. Joseph Morano
*Assistant Examiner*—Frantz F. Jules
(74) *Attorney, Agent, or Firm*—McGlew and Tuttle, P.C.

(57) ABSTRACT

A girder (11) for the production of a track system for track-bound vehicles, in particular a magnetic levitation train, includes a plurality of carriers. The girder has a heat-insulating cover (23) mounted at its upper side. The cover (23) rests on a floating bearing.

19 Claims, 3 Drawing Sheets

GIRDER FOR THE PRODUCTION OF A TRACK FOR A TRACK-BOUND VEHICLES, IN PARTICULAR A MAGNETIC LEVITATION RAILWAY, AND TRACK PRODUCED THEREWITH

FIELD OF THE INVENTION

The invention relates to a girder for the production of a track for track-bound vehicles, in particular a magnetic levitation railway, with a heat-insulating cover mounted at its upper side and to a track produced therewith.

BACKGROUND OF THE INVENTION

Girders and tracks of this type are widely known (e.g. DE 39 28 277 C1, DE 39 28 278 C2). They serve for tracking and accommodation of functional components and/or equipment parts such as stator packs, lateral guide rails, and sliding tracks which act together with relevant functional components mounted at the vehicle, for example carrier, exciter, brake and guide magnets as well as carrier skids or similar components.

The girders can be made of steel or concrete and be configured as single-span or multispan girders. To allow for thermal expansion they are supported by the aid of fixed or movable bearings on columns or on a substructure erected on the ground (e.g. DE 34 04 061 C1). Single-span girders are supported at one end by means of a fixed bearing and at the other end by means of a movable bearing, while two-span girders are supported by means of a movable bearing each at both ends and in the middle area by means of a fixed bearing. Girders comprised of more than two spans, e.g. like those applied in the area of turnouts, are equipped, in addition to the end-side movable bearings, with two or more bearings that permit thermal expansion in horizontal direction, but largely prevent vertical movement. For example, the practical construction lengths for two-span girders amount to 30 m to 60 m, while these lengths amount to roughly half that value for single-span girders.

Girders of the type described herein above can bend convexly if subjected to the influence of temperature fluctuations, particularly vertically to their longitudinal direction. While the top and bottom chords of these girders assume the same temperature if warmed-up evenly and simultaneously, thus expanding and/or contracting nearly evenly in longitudinal direction, girders get bent, for example if subjected to solar radiation, because the top chords get warmed-up faster than the bottom chords if subjected to solar radiation, and thus they are expanded stronger than the bottom chords. With single-span girders a bending-up of this type vertically to the girder longitudinal axes takes place with a much higher, approx. three times higher amplitude than that for two-span and multispan girders, because a deformation practically cannot occur in the area of the central fixed bearing.

Deformations of this type as described hereinabove lead to a waving of the track, thus affecting travel comfort. Even a safe and secure tracking and, in case of a magnetic levitation track, the contactless levitation may be endangered by too serious a deformation. Therefore, to avoid such problems, it is common practice to use only two-span and multispan girders, putting up with those disadvantages in view of production, transport, and assembly resulting from the increased construction size and heavier weight.

To reduce the deformation of the girders, it had already been proposed to mount a heat-insulating cover made of polystyrene high-resistance foam on their upper side and a protective layer made of glass fiber concrete on top of it. However, tests run for this purpose were stopped, because it is difficult to achieve sufficient fatigue strength for such covers. In particular, during the usual operation of a track produced with such girders, high transverse and shearing stresses affecting the fatigue strength develop due to the different thermal expansion of the girder material as compared with the material of the covers on the one hand and due to the different types of coating on the other hand.

SUMMARY OF THE INVENTION

In contrast therewith, it is the task of this invention to provide a heat-insulating cover that is stable and durable, withstanding those strains and stresses occurring during track operation in the event of strong solar radiation.

According to the invention, a girder for the production of a track for track-bound vehicles, in particular a magnetic levitation railway is provided with a heat-insulating cover mounted at an upper side. The cover rests on a floating bearing.

According to another aspect of the invention, a track for track-bound vehicles, in particular for a magnetic levitation railway has a plurality of girders arranged one behind another in the direction of travel. At least selected girders are configured with a heat-insulating cover mounted at an upper side. The cover rests on a floating bearing.

The invention bears the advantage that the heat-insulating covers, because of their floating support, do not belong to the stability system of the girders. Thus, stresses in the cover due to different coefficients of expansion are minimized. Therefore, plates consisting of high-grade materials, e.g. solar cell modules, serving for additional purposes, can also be used for these covers. In particular, it brings the advantage that due to the effective and durable heat insulation, it is possible to ensure so little temperature differences between the top and bottom chords permanently, even in the event of strong solar radiation, that single-span girders will not get more deformed than appropriately sized two-span or multispan girders.

The cover may be formed by a plurality of insulating elements, each of them resting on a floating bearing of their own. The insulating elements may be fixed with collars made of an elastic material at their surface. The collars may consist of a rubber-like material. The collars may be fixed by the aid of clamping rails at the girder upper side. The insulating elements may be at least partly provided with photovoltaic solar cells.

A cavity that is continuous in the direction of travel may be provided under the cover.

The girder may be provided on its upper side with laterally mounted functional components in the form of gliding tracks. The cover may be arranged between the gliding tracks.

A top chord may be arranged between the gliding tracks, forming a bottom of the cavity. The top chord may feature a deepening between the gliding tracks destined for the formation of the cavity. The selected girders may be configured as single-span girders. The cavity may be utilized for the accommodation of lines and cables.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
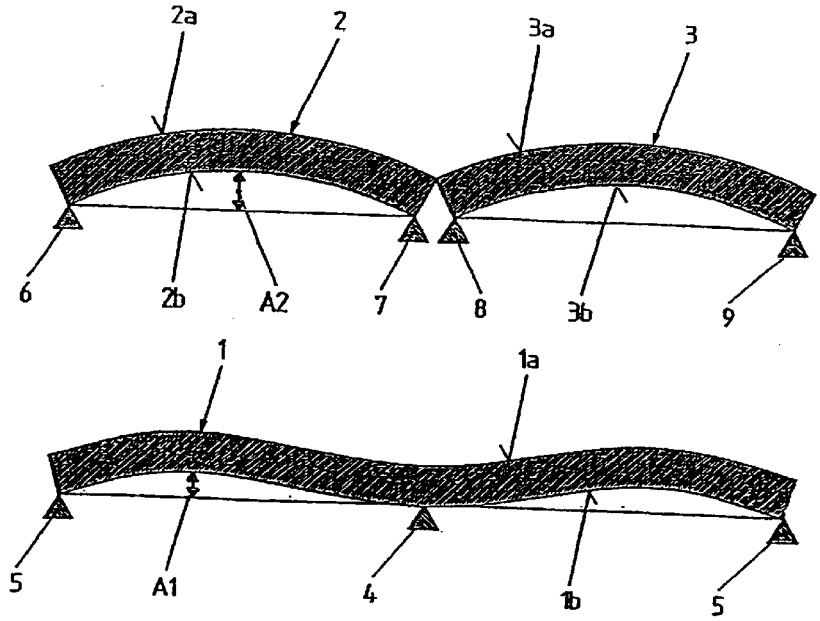
FIG. 1 is a schematic view of one single-span and one two-span girder each as well as the deformation occurring when subjected to solar radiation.

Referring to the drawings in particular, FIG. 1 roughly schematically shows a two-span girder 1 and two single-span girders 2 and 3 arranged one behind another in their longitudinal direction, which together have roughly the same length as the two-span girder 1. The girder 1 is supported in its middle area with a fixed bearing 4 and at both ends with one movable bearing 5 each. The girder 2 is supported with a movable bearing 6 at the left end shown on FIG. 1 and with a fixed bearing 7 at the other end, while the girder 3 is supported with a fixed bearing 8 at its end facing the girder 2 and with a movable bearing 9 at the other end. For the sake of simplicity, the supports of the substructures on which the bearings 5 to 9 are mounted are not represented here.

Figure 2:
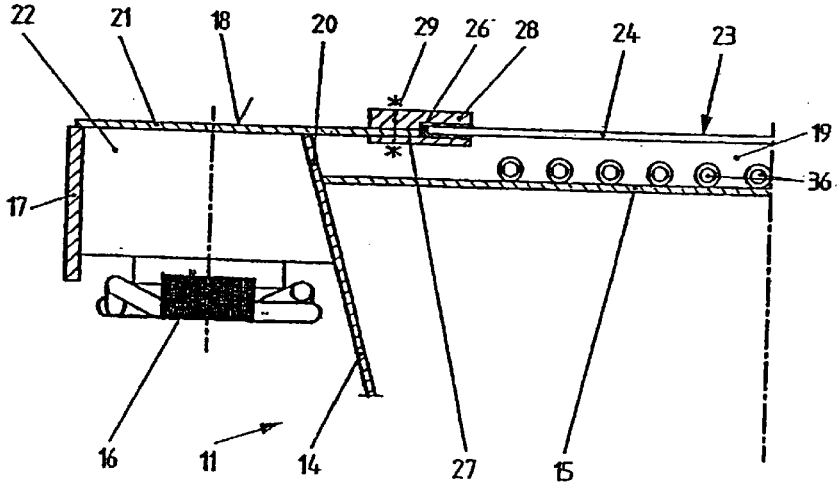
FIG. 2 is a cross-sectional view through a steel girder according to the invention.
Figure 3:
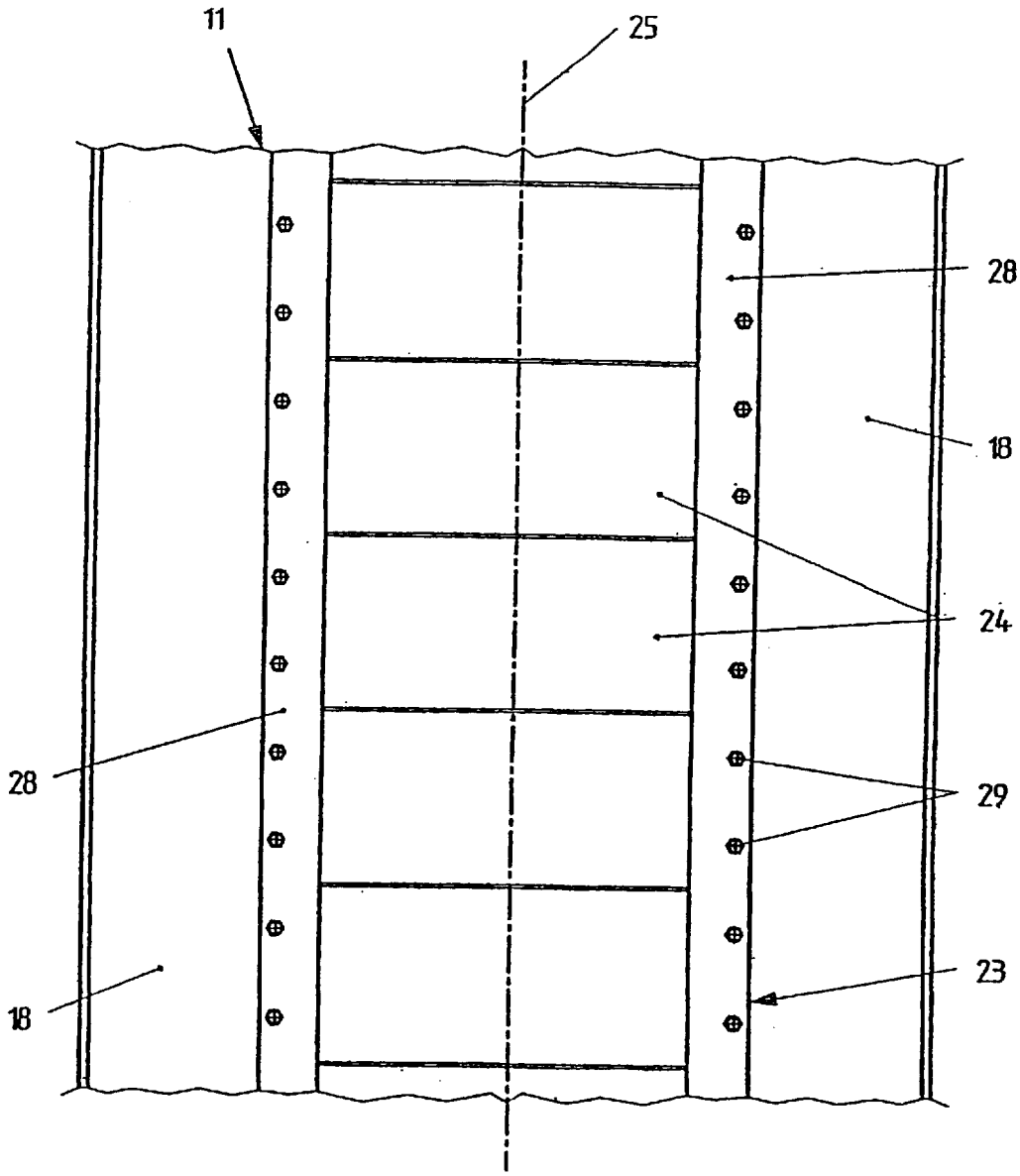
FIG. 3 is a top view on one section of a track formed by several steel girders as per FIG. 2.
Figure 4:
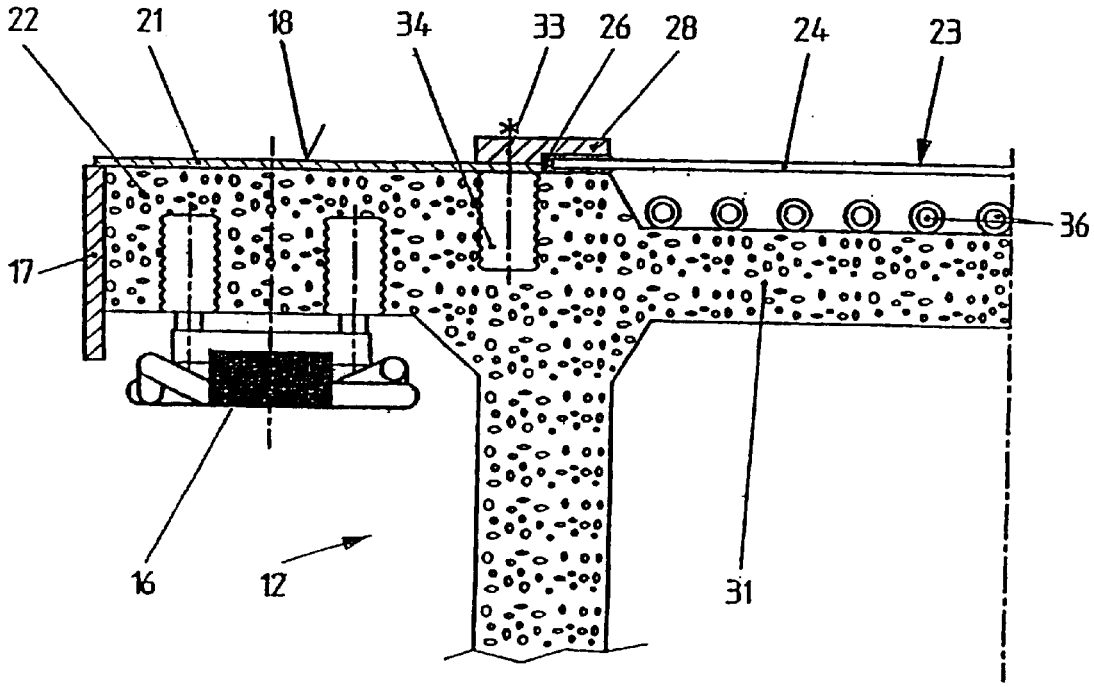
FIG. 4 is a cross-sectional view through a concrete girder according to the invention.

The assumption taken in the following description is that the girders 1, 2, and 3 and the examples for execution as per FIG. 2 to 4 represent girders for a magnetic levitation track, with the girder 1 having a length of 50 m, and the girders 2 and 3 having a length of 25 m each, for example. The cross-sections of the girders 1, 2, and 3, for example, are mainly triangular. No matter whether it is a steel or a concrete girder, the girders 1 to 3, as one can see on FIG. 1, may bend-up convexly in upward direction if subjected to strong solar radiation, because they are warmed-up in the area of their top chords 1*a*, 2*a*, and 3*a* much faster than in the area of their bottom chords 1*b*, 2*b*, and 3*b*. For example, if there is a temperature difference in the amount of 25° C., there may develop bending amplitudes A1 for the girder 1 in the amount of approx. 3 mm and AZ for the girder 2 (or 3) in the amount of approx. 10 mm, the latter being intolerable.

Girders of this type as described hereinabove are widely known and need not be explained more closely. Just for the sake of giving an example, reference is made here to the printed publications DE 3404061 C1, DE 39 28 277 C1, and ZEV-Glas, Ann. 105,1981, No. 7/8, S. 204–215), which are hereby made a subject of the present manifestation to avoid repetition by reference.

To avoid too high temperature differences between the top and bottom chords, girders 11 made of steel as per FIG. 2 and 3 and girders 12 made of concrete as per FIG. 4 are provided according to the invention, only showing the girder halves at left. The relevant girder halves at right may be configured mirror-symmetrically to the girder halves at left, and besides, the girders 11, 12 may be configured and sized analogously to girders 1 to 3 as per FIG 1.

According to FIG. 2, the girder 11, for example, has a triangular cross-section which is formed by two obliquely arranged side parts 14 which at their upper side are connected, preferably by welding, by a plate-like top chord 15 and at their lower side by a tube-like or plate-like bottom chord which is not shown here. Moreover, at its upper, external side the girder 11 features three functional components which, for example, consist of a long stator section 16 of a usual long stator linear motor, a lateral guide rail 17, and a sliding track 18 on which a magnetic levitation vehicle not shown here can glide, if required, with carrier and gliding skids mounted to it.

While the gliding tracks 18 usually connect continuously to the upper surface of the top chord 15 of girder 11, the top chord 15 and/or a central top chord section, according to this invention, is arranged under the gliding tracks 18 and in parallel to them, i.e. lowered versus the gliding tracks 18. Thereby, a cavity is created between the plane formed by the gliding tracks 18 and the upper side of the top chord 15, said cavity being limited towards the sides by webs 20 which prolong the side parts 14 beyond the top chord 15 and at which strips 21 are affixed, e.g. by welding, whose surfaces form the gliding tracks 18. Moreover, at the strips 21 and webs 20, certain web plates 22 may be affixed to fasten the long stator sections 16 and the lateral guide rails 17.

The cavity 18 which is open towards the top is covered by a heat-insulating, a weather-resistant cover 23 which features a surface preferably arranged flush to the gliding tracks 18 and which expediently extends only over the width of girder 11 which is available between the gliding tracks 18 so that it cannot be destroyed if the carrier skids possibly touch-down onto the gliding tracks 18.

According to the invention, the cover 23 is composed of quadratic and/or rectangular insulating elements 24, consisting of individual plates, (vide FIG. 3, too) which are arranged at a butt joint one behind another in the direction of a longitudinal axis 25 of girder 11. To avoid that the insulating elements 24 produced of a thermal insulation material, e.g. gas concrete, are exposed to too great stresses due to their different thermal expansion coefficients as compared with steel if subjected to strong heat or cold, they are supported in a floating arrangement at girder 11 and thereby uncoupled from the stability system of girder 11. For this purpose, the side rims of the insulating elements 24 running in parallel to the longitudinal axis 25 are bordered with U-shaped collars 26 made of an elastic material, e.g. a rubber-like material. On the other hand, the collars 26 are restrained between a clamping rail 27 connected, e.g. by welding, to the pertaining strip 21 and another clamping rail 28 which, for example, is solidly connected by bolts 29 and nuts with the clamping rail 26. The clamping rails 27, 28 may expediently extend over the whole length of the girder 11, as shown on FIG. 3.

An appropriate cover 23 is provided for the girder 12 made of concrete as per FIG. 4, in which equal parts bear the same reference marks as in FIG. 2 and 3. For this purpose, the girder 12 consistently made of concrete features a top chord 31 with an upper side which features a deepening that forms a cavity 32, said deepening being covered at its top by a cover 23 analogously to FIG. 2 and limited at its bottom by the top chord 3 1. Here, in contrast with FIG. 2 and 3, it is only required to provide the upper clamping rail 28 because it can be affixed by means of bolts 33 and dowels 34 or likewise directly at laterally projecting parts 35 of girder 12 which carry the strips 21. In this case, the collars 26 are firmly restrained between a girder section connecting the parts 35 with the top chord 31 and the clamping rails 28, but uncoupled from girder 12. Therefore, in the top view, the arrangement as per FIG. 4, corresponds to the top view of the arrangement as per FIG. 2 shown in FIG. 3.

The collars 26 are made of a durable, weather-resistant material, e.g. natural rubber.

Moreover, they may extend over the whole length of girders 11, 12 measured in parallel to the longitudinal axis 25 (FIG. 3) or be comprised of individual pieces bordering only one plate or several plates 24. The thickness and elasticity of the collar material are properly chosen to attain the desired floating support, to accommodate stresses from the collars 26 resulting from different thermal expansion and to prevent cracks or the like in the insulating elements 24 due to temperature.

According to a type of execution of this invention, which is particularly preferred and considered to be the best, the insulating elements 24 consist of plate-type solar cell modules. For example, such modules may consist of crystalline silicon semiconductor layers covered by protective layers made of glass or plastic or otherwise encapsulated in a weather-resistant, though translucent manner. Alternatively, solar cells formed with amorphous silicon or the like or thin-layer and/or thin-film cells developed more recently can also be applied which are sprayed onto appropriate carrier plates made of glass, plastic, or another suitable heat-insulating material. It yields the advantage that the girders 11, 12 assume a new function, viz. generating electric energy by means of photovoltaics. The produced electric energy can be fed into the public power net or, if it causes intolerable fluctuations in electric power due to the formation of shadows occurring during the passage over the magnetic levitation track, be treated and utilized for the production of hydrogen for fuel cells, for example, which in future will be suitable for ecologically advantageous drive aggregates for automobiles or for the supply of energy to the magnetic levitation track itself.

The cavity 19 preferably serves as cable duct, i.e. to accommodate electric lines and cables 36, particularly those serving for the electric connection of the different solar cell modules along the whole girder 11, 12. Moreover, the section cables needed for supply of energy to the sections of the long stator motor and laid along the track between the substations can be accommodated in the cavities 19. Alternatively and additionally, the lines of the operation management system required to control and supervise the sequence of operation of the vehicles as well as electric power or telephone cables or the like from public networks could also be accommodated in the cavities 19. The latter lends itself suitable especially in densely populated areas.

Thus, the described girders 11 and 12 are suitable for the production of a multi-functional track, in particular for magnetic levitation tracks, where a plurality of girders as shown in FIG. 3 is arranged one behind the other in the direction of travel (and/or in the direction of longitudinal axes 25) and where at least selected and preferably all girders are configured like the described girders 11 and 12. In this manner, the cavities 19 may form cable ducts extending over the whole track, the solar cell modules forming a photovoltaic power station extending over the whole track too. Thus, extra costs for cable ducts to be installed in the soil are saved, while on the other hand revenues are obtained from the exploitation of solar energy.

Apart from the multiple functionality, the described girders 11, 12 and the tracks producible thereof bring the advantage of effective and durable heat insulation for the top chords 15, 31 of girders 11, 12. By way of an appropriate selection of the material and thickness of the insulating elements 24, the temperature differences between the top and bottom chords of girders 11, 12 can be kept small, even if subjected to strong solar radiation. Thus the deformation explained by way of FIG. 1 can be reduced so much that the single-span girders 2,3 do not get deformed stronger than the two-span girders 1. Therefore, as an alternative to the recent practice for tracks of the type being of interest here, it is possible to use mostly single-span girders reduced in weight and size whereby substantial simplification and cost savings can be achieved in terms of production, transport, and assembly.

The invention is not restricted to the examples of execution described herein, which can be modified in many ways. In particular, the invention is also applicable to girders and girder sections other than those described and to top chords of a different configuration. In particular, it would be possible to arrange the surfaces of the top chords 15, 31 at one plane with the gliding tracks 18 and the covers 23, by formation of cavities 19, sufficiently far above the gliding tracks 18, if permitted by the height of the carrier skids possibly touchingdown on them. Moreover, the a.m. floating support by means of collars 26 can also be ensured by other suitable means, with it also being possible to replace the plate-type insulating elements 24 with other suitable means for thermal insulation, for example with cassettes filled with loose thermal insulation material. And it is clear that it can also be girders for the tracks of vehicles other than magnetic levitation vehicles. Finally, it is understood that the individual features can also be applied in combinations other than those represented and described.

While specific embodiments of the invention have been shown and described in detail to illustrate the application of the principles of the invention, it will be understood that the invention may be embodied otherwise without departing from such principles.

What is claimed is:

1. A girder for the production of a track for track-bound vehicles of a magnetic levitation railway, the girder comprising: a girder upper side; a heat-insulating cover mounted at said girder upper side; and a plurality of floating bearings connected to said girder upper side and supporting said heat-insulating cover relative to said girder upper side, said cover being formed by a plurality of insulating elements, each of said insulating elements resting on a respective one of said floating bearings, each of said floating beatings comprises collars made of an elastic material at their surface, said insulating elements being fixed with said collars.

2. A girder pursuant to claim 1, wherein said collars consist of a rubber-like material.

3. A girder pursuant to claim 1, further comprising clamping rails wherein said collars are fixed by said clamping rails at said girder upper side.

4. A girder pursuant to claim 1, wherein said insulating covers are at least partly provided with photovoltaic solar cells.

5. A girder pursuant to claim 1, wherein said girder upper side includes a top defining a cavity, said cavity extending in a direction of travel for the track-bound vehicles, said cover extending over said top.

6. A girder, comprising: a girder upper side;

a heat-insulating cover mounted at said girder upper side; and a floating bearing connected to said girder upper side and supporting said heat-insulating cover relative to said girder upper side, wherein said girder upper side has laterally mounted gliding tracks, said cover being arranged supported between said gliding tracks.

7. A girder pursuant to claim 6, wherein said girder upper side is made of steel and includes a top chord arranged between said gliding tracks and forming a bottom of a cavity, said cover being supported above said cavity.

8. A girder pursuant to claim 6, said girder upper side is made of concrete, said girder top side including a top chord with a deepening between said gliding tracks defining a cavity, said cover being supported above said cavity.

9. A girder according to claim 6, wherein, said floating bearing is provided as a plurality of floating bearings and said cover is formed by a plurality of insulating elements, each of said insulating elements resting on a respective one of said floating bearings, each of said floating bearings comprises collars made of an elastic material at their surface, said insulating elements being fixed with said collars.

10. A girder according to claim 6, wherein said insulating cover is at least partly provided with photovoltaic solar cells.

11. A girder according to claim 6, wherein said girder upper side comprises steel or concrete and said girder upper side includes a top chord between said gliding tracks forming a bottom of a cavity under said cover.

12. A track for track-bound vehicles of a magnetic levitation railway, the track comprising: a plurality of girders arranged one behind another in the direction of travel, at least one of said girders comprising: a girder upper side; a rigid heat-insulating cover mounted at said girder upper side; and floating bearings connected to said girder upper side, said floating bearings supporting each of two sides of said heat-insulating cover with said rigid heat-insulating cover rigidly extending between said floating bearings, wherein said at least one girder upper side includes a top chord arranged between gliding tracks and forming a bottom of a cavity defined under said cover and further comprising lines and cables accommodated in said cavity.

13. A track pursuant to claim 12, wherein said at least one of said girders is configured as a single-span girder.

14. A magnetic levitation railway girder, the girder comprising:

a girder upper side having laterally mounted gliding tracks and a top chord arranged between said gliding tracks;

a heat-insulating cover mounted at said girder upper side said cover arranged between said gliding tracks above said top chord; and floating bearings connected to said girder upper side, one of said floating bearings being disposed adjacent to one of said gliding tracks and another of said floating bearings being disposed adjacent to another of said gliding tracks, said floating bearings cooperating to support said heat-insulating cover rigidly therebetween.

15. A girder according to claim 14, wherein said cover is formed by a plurality of insulating elements, each of said insulating elements resting on a respective set of said floating bearings, wherein said floating bearings each comprise a collar made of an elastic material at a surface, said insulating elements being fixed with said collars.

16. A girder according to claim 15, further comprising clamping rails wherein said collars are fixed by said clamping rails at said girder upper side.

17. A girder according to claim 14, wherein said insulating covers are at least partly provided with photovoltaic solar cells.

18. A girder according to claim 14, wherein said girder upper side is made of steel and said top chord between said gliding tracks forms a bottom of a cavity defined under said cover.

19. A girder according to claim 14, wherein said girder upper side is made of concrete and said top chord forms a deepening between said gliding tracks and forms a cavity below said cover.

* * * * *